US005253620A

United States Patent [19]

Dohn et al.

[11] Patent Number: 5,253,620

[45] Date of Patent: Oct. 19, 1993

[54] INTERNAL COMBUSTION ENGINE ADJUSTABLE VALVE GEAR

[75] Inventors: Michael Dohn, Esslingen; Karl Zeilinger, Winnenden, both of Fed. Rep. of Germany

[73] Assignee: Mercedes-Benz AG, Fed. Rep. of Germany

[21] Appl. No.: 25,257

[22] Filed: Mar. 2, 1993

[30] Foreign Application Priority Data

Mar. 20, 1992 [DE] Fed. Rep. of Germany ..... 4209062

[51] Int. Cl.[5] ..... F01L 1/12; F01L 1/18; F01L 1/26

[52] U.S. Cl. ..... 123/90.16; 123/90.22; 123/90.23; 123/308; 123/432

[58] Field of Search ..... 123/90.15, 90.16, 90.17, 123/90.22, 90.23, 90.27, 90.39, 90.4, 90.41, 90.44, 308, 432

[56] References Cited

U.S. PATENT DOCUMENTS

| | | | |
|---|---|---|---|
| 4,134,371 | 1/1979 | Hausknecht | 123/90.15 |
| 4,721,007 | 1/1988 | Entzminger | 123/90.16 |
| 5,003,939 | 4/1991 | King | 123/90.16 |
| 5,025,761 | 6/1991 | Chen | 123/90.16 |
| 5,119,773 | 6/1992 | Schön et al. | 123/90.16 |
| 5,189,998 | 3/1993 | Hara | 123/90.6 |

FOREIGN PATENT DOCUMENTS

| | | | |
|---|---|---|---|
| 2949529 | 6/1981 | Fed. Rep. of Germany . | |
| 3332789x | 3/1984 | Fed. Rep. of Germany . | |
| 3831642 | 3/1990 | Fed. Rep. of Germany . | |
| 168207 | 9/1984 | Japan | 123/90.16 |
| 231115 | 12/1984 | Japan | 123/90.16 |
| 83/01483 | 4/1983 | World Int. Prop. O. . | |
| 83/04070 | 11/1983 | World Int. Prop. O. . | |

*Primary Examiner*—Willis R. Wolfe
*Assistant Examiner*—Weilun Lo
*Attorney, Agent, or Firm*—Evenson, McKeown, Edwards & Lenahan

[57] ABSTRACT

An adjustable valve gear is provided for two lift-type intake valves per cylinder in an internal combustion engine which are actuated by the cams of a camshaft via rocker arms with variable support and a rocker cam. In order to make possible different lift curves for the two lift-type intake valves, each lift type intake valve is assigned a separate rocker cam. At least one of the curve joints assigned to a lift-type intake valve and establishing the connections between a cam and a rocker arm, between the rocker arm and its support and between a rocker cam and the lift-type intake valve are configured with a different shape or a rotated installation position relative to a curve joint assigned to the other lift-type intake valve.

5 Claims, 3 Drawing Sheets

INTERNAL COMBUSTION ENGINE ADJUSTABLE VALVE GEAR

BACKGROUND AND SUMMARY OF THE INVENTION

The present invention relates to an adjustable valve gear and, more particularly, to an adjustable valve gear for at least two lift-type intake valves per cylinder in an internal combustion engine having at least one camshaft with cams, each of which actuates a respective rocker arm via a first curve joint situated in a central region thereof, each of which rocker arm is supported via a second curve joint in a region of a longitudinal end thereof on an adjusting shaft, with a support position adjustable as a function of operating parameters including speed and load of the internal combustion engine by rotation of the adjusting shaft in an adjustment path, and which is articulated in a region of another longitudinal end on a respective rocker cam pivotable about a pivot supported on a housing of the internal combustion engine and rests on the respective lift-type intake valve via a third curve joint comprising a respective base-circle track and an adjoining cam track on the rocker cam.

An adjustable valve gear is shown in DE 38 31 642 A1. In this known valve gear, the two lift-type intake valves of a cylinder are actuated via a common rocker cam, with the result that the two valve lift curves of the lift-type intake valves are always the same as one another.

DE 33 32 789 C2 and DE 29 49 529 A1 disclose other types of adjustable valve gears having two lift-type intake valves per cylinder, in which the valve lift curve of one lift-type valve is unchangeable, while the phase relation of the valve lift curve of the other lift-type valve can be changed to particular end positions and intermediate positions without a change in the lift height and the lift duration being possible.

An object on which the present invention is based is to better match in an adjustable valve gear the valve lift curves to the operating conditions of the internal combustion engine with a low outlay, without sacrificing the possibility of a change in the lift duration, the lift height and the phase relation of the valve lift curves.

The foregoing object has been achieved according to the present invention by providing that each lift-type intake valve is operatively associated with a separate rocker cam and at least one of the three curve joints associated with one of the lift-type intake valve differs from the similar curve joint associated with another lift-type intake valves of the same cylinder such that the lift curve of the one lift-type intake valve differs from the lift curve of the other lift-type intake valve in the same position of the adjusting shaft over at least part of the adjustment path of the adjusting shaft.

In the case of the valve gear configured in accordance with the present invention, it is possible, while retaining just one adjusting shaft and, if required, just one camshaft, (i.e., with little outlay) for the two lift-type intake valves to achieve different valve lift curves for the same operating conditions of the internal combustion engine while retaining the possibilities of adjustment as regards the phase relation, lift duration and lift height. It is thus possible to match the opening of the lift-type intake valves optimally to any operating condition of the internal combustion engine.

The different valve lift curves can be achieved in accordance with the present invention by different configurations of one or more curved tracks forming the curve joints or by identical configuration but arrangement of the curved tracks in a manner rotated relative to one another. In the former, there is greater freedom as regards the differing configuration of the valve lift curves while, in the latter, the outlay is further reduced by the production of identical surfaces and parts.

The present invention also makes possible, without any further outlay, operation of the internal combustion engine with just one opening lift-type intake valve. This is advantageous particularly at low speed and load, or complete shut-down of a cylinder.

The present invention further results in a particularly small space requirement for the valve gear overall while retaining all possibilities of changing of the intake-valve lift curves since a separate rocker-lever bearing shaft is not required and all valves can be actuated via a single camshaft.

BRIEF DESCRIPTION OF THE DRAWINGS

These and further objects, features and advantages will become more readily apparent from the following detailed description of the present invention when taken in conjunction with the accompanying drawings wherein.

DETAILED DESCRIPTION OF THE DRAWINGS

Figure 1:
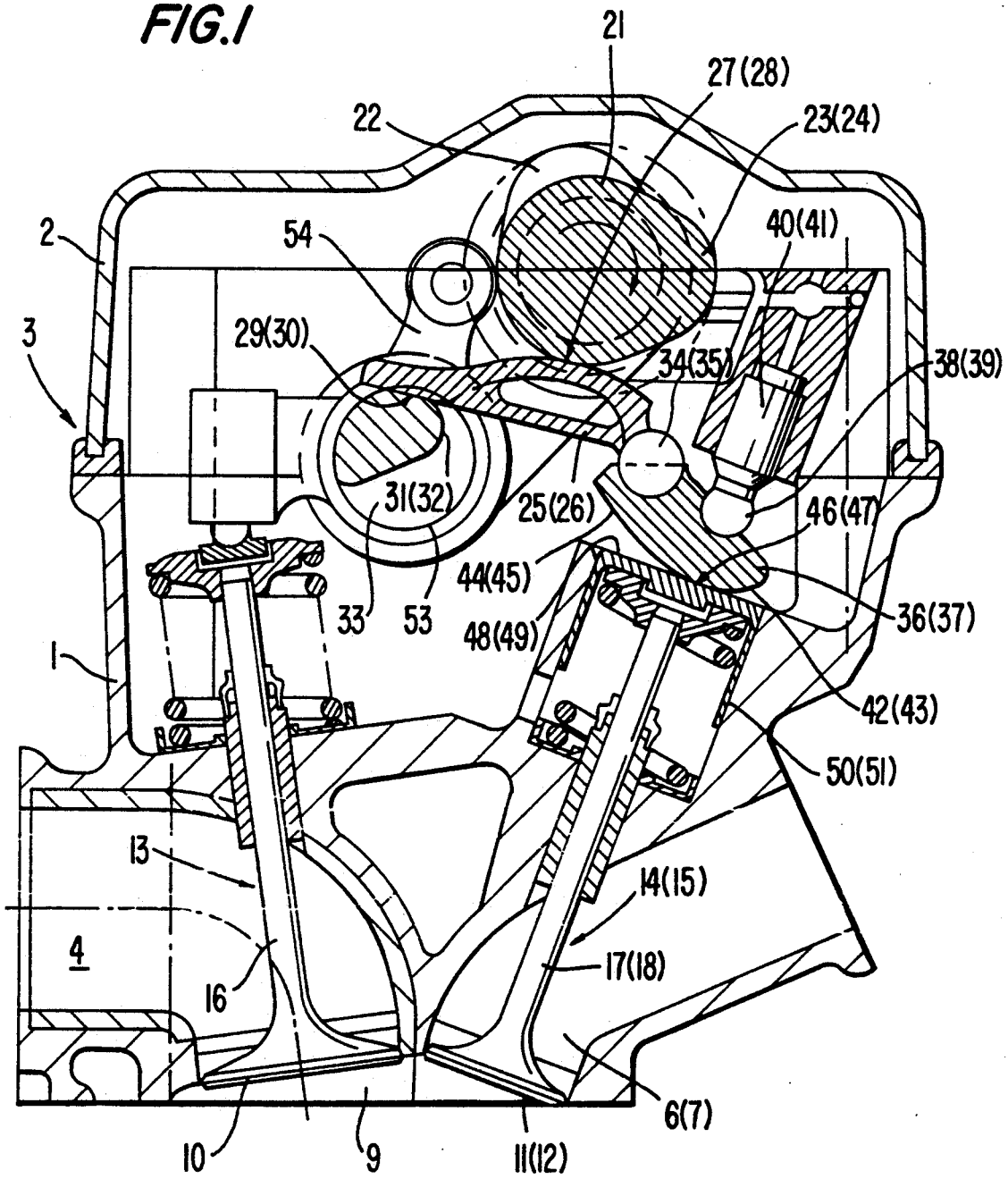
FIG. 1 is a cross-sectional elevation view of a cylinder head of a reciprocating-piston internal combustion engine with a valve gear for three lift valves.

A cylinder head housing 1 and a cylinder head cover 2 are part of a cylinder head 3 of a reciprocating internal combustion engine (not shown in further detail). One exhaust passage 4 and two intake passages 6, 7 per cylinder, the latter lying one behind the other in FIGS. 1 and 2 and being separated from one another by a wall 5, are arranged in the cylinder head housing 1. The outlets of the exhaust and intake passages 4, 6, 7 into a combustion space 9 (depicted partially) can be closed by valve discs 10, 11, 12 of a lift-type exhaust valve 13 and two lift-type intake valves 14, 15, respectively which are mounted in substantially longitudinally displaceable manner in the cylinder head housing 1 by way of their valve stems 16, 17, 18. Two spark plugs 19, 20 (FIG. 2) projecting into the combustion space 9 are arranged laterally between the exhaust passage 4 and the two intake passages 6, 7 in the cylinder head housing 1.

The lift-type valves 13, 14, 15 are actuated by a single camshaft 21, which carries a separate cam 22, 23, 24 for each lift-type valve 13, 14, 15. Each of the two cams 23, 24 assigned to a lift-type intake valve 14, 15 forms, together with an arched central part resting against it of a rocker arm 25, 26, a first curve joint 27, 28. Each rocker arm 25, 26 is supported by one of its longitudinal ends on a cam track 31, 32 of a common rotatable adjusting shaft 33, forming a second curve joint 29, 30. At its other longitudinal end, each rocker arm 25, 26 is articulated by way of a ball or cylinder joint 34, 35 on a rocker cam 36, 37. Each of these rocker cams 36, 37 is supported on the cylinder head housing 1 via a ball joint 38, 39, and it is possible for a valve play compensation element 40, 41 to be arranged therebetween.

In the illustrated embodiment, the ball joints 38, 39 are arranged laterally of the rocker arms 25, 26. However, they can also be arranged between the adjusting shaft 33 and the ball joints 34, 35, with the rocker cams 36, 37 thus coming to lie in a space-saving manner underneath the rocker arms 25, 26. Each rocker cam 36, 37 rests by a base-circle track 42, 43, which is central with respect to the ball joint 38, 39, and an adjoining cam track 44, 45, thereby forming a third curve joint 46, 47, against a flat sliding track 48, 49 of a tappet 50, 51, each of which rests on a valve stem 17, 18. The rocker cams 36, 37 are spring-loaded (in a conventional manner not shown) in order to ensure that the rocker arms 25, 26 are in contact at all times with the cam shaft 21.

Figure 2:
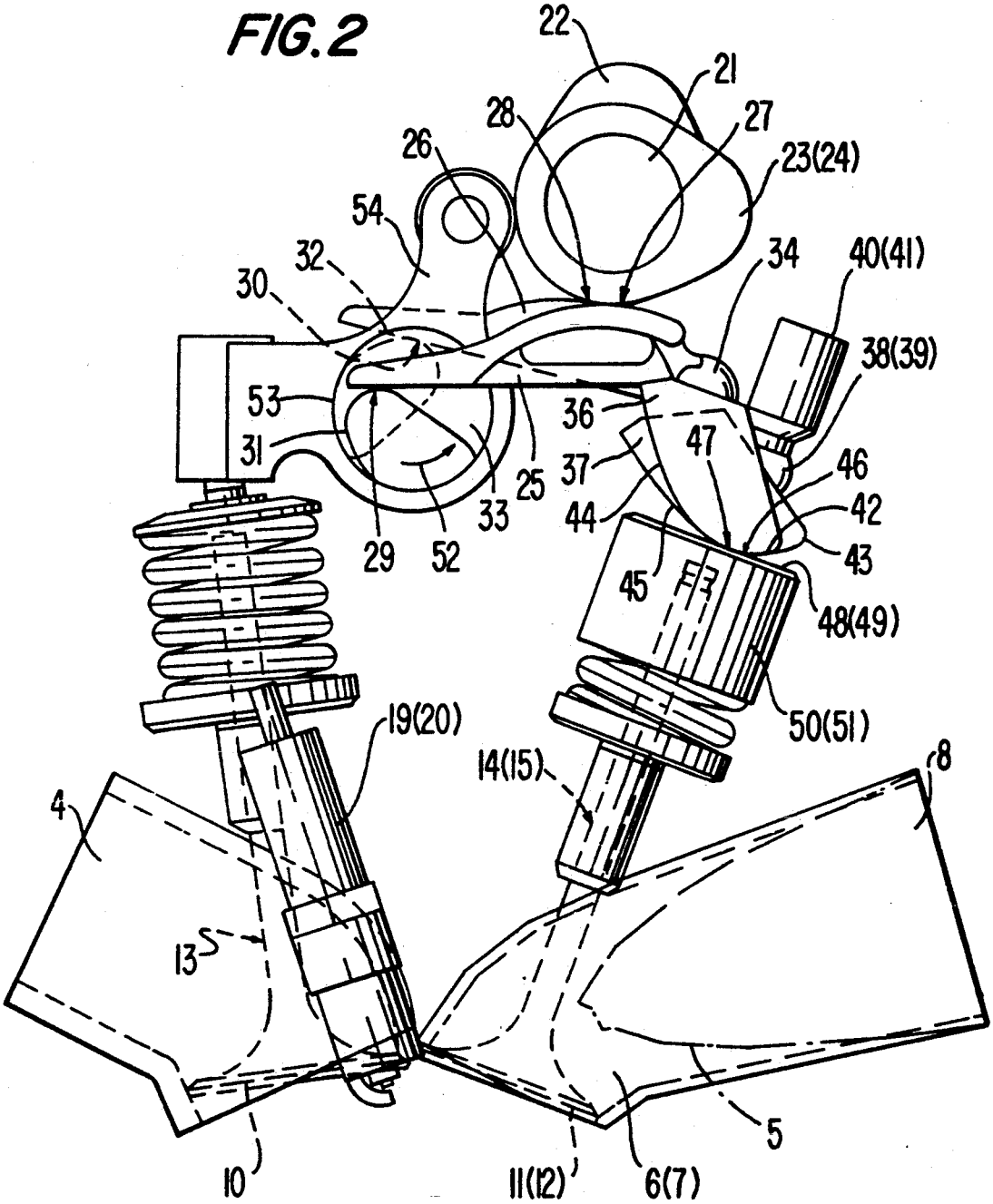
FIG. 2 is an isolated view of certain of the features of FIG. 1.
Figure 3:
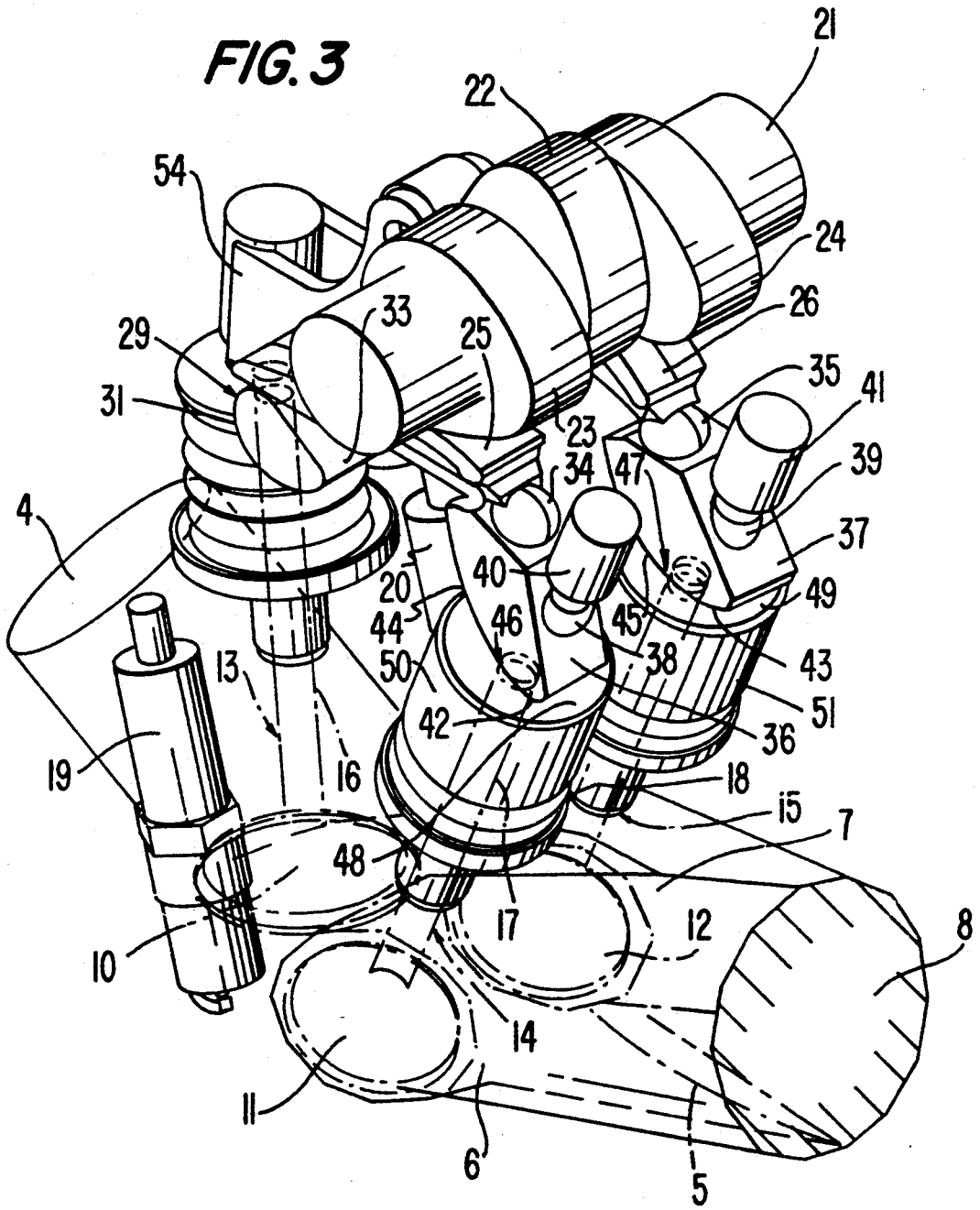
FIG. 3 is an isolated perspective view of the certain of the features of FIGS. 1 and 2.

As can be seen clearly in FIGS. 2 and 3, the two rocker cams 36, 37, while having the same configuration with respect to the base-circle tracks 42, 43 and the cam tracks 44, 45, occupy positions rotated by a considerable amount relative to one another for a particular position of the camshaft 21. As a result, during an actuation of the rocker arms 25, 26 by the cams 23, 24, the sliding duration of the base-circle track 42 o the sliding track 48 is considerably longer than the sliding duration of the base-circle track 43 on the sliding track 49 and, accordingly, that of the cam track 44 is shorter than that of the cam track 45. Different valve lift curves thus result, more specifically, in the example depicted, such that the lift-type valve 14 assigned to the rocker cam 36 has a considerably shorter opening duration and a smaller maximum stroke than the other lift-type valve 15.

The different positions of the two rocker cams 36, 37 relative to one another are achieved by arranging the two cam tracks 31, 32, of intrinsically identical configuration, in a manner rotated relative to one another on the adjusting shaft 33, with the result that the two second curve joints 29, 30 are different from one another. As can be seen, in particular, in FIG. 2, when the adjusting shaft 33 is rotated in the counterclockwise direction (arrow 52 in FIG. 2) all that occurs initially is that rocker arm 25 reaches cam track 31, thereby resulting in a change in the lift curve of the lift-type valve 14, whereas the position of the rocker arm 26 and hence the lift curve of the lift-type valve 15 initially remains unchanged due to the fact that the rocker ar 26 slides along a circular track 53 of the adjusting shaft 33, until, upon further rotation of the adjusting shaft 33, the rocker arm 26 comes to bear against the cam track 32. The freely selectable extent of the rotation of the two cam tracks 31, 32 relative to one another here determines, in particular, the beginning of the change in the lift curve of the lift-type valve 15. Different changes in the valve lift curves can be achieved by different configurations of the two cam tracks 31, 32. It is readily apparent that it is also possible, instead of or in addition to configuring the two second curve joints 29, 30 differently, to configure the first and/or third curve joints 27, 28 and 46, 47, respectively, differently from one another. Thus, different curvatures of the two rocker arms 25, 26 or different cam tracks 44, 45 of the two rocker cams 36, 37 can be provided.

A further advantage is obtained if a rocker lever 54 driven by the cam 22 of the camshaft 21 and actuating the lift-type exhaust valve 13 is mounted on a cylindrical section of the adjusting shaft 33. This saves not only the outlay for a separate rocker-lever pivot but also results in a particularly space-saving arrangement of all the valve drive elements.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. An adjustable valve gear for at least two lift-type intake valves per cylinder in an internal combustion engine having at least one camshaft with cams each arranged to actuate a respective rocker arm via a first curve joint situated in a central region thereof, each rocker arm being supported via a second curve joint in a region of a longitudinal end thereof on an adjusting shaft, with a support position adjustable as a function of operating parameters including speed and load of the internal combustion engine by rotation of the adjusting shaft in an adjustment path, and articulated in a region of another longitudinal end on a respective rocker cam pivotable about a pivot supported on a housing of the internal combustion engine and rests on the respective lift-type intake valve via a third curve joint comprising a respective base-circle track and an adjoining cam track on the rocker cam, wherein each lift-type intake valve is operatively associated with a separate rocker cam and at least one of the three curve joints associated with one of the lift-type intake valve differs from the similar curve joint associated with another lift-type intake valve of the same cylinder such that the lift curve of the one lift-type intake valve differs from the lift curve of the other lift-type intake valve in the same position of the adjusting shaft over at least part of the adjustment path of the adjusting shaft.

2. The adjustable valve gear according to claim 1, wherein surfaces of the rocker arms in an actuating region of the cams constitute at least one of the first curve joints, supports for the adjusting shaft forming the second curve joints, and the base-circle tracks and cam tracks of the rocker cams, which tracks form the third curve joints, and the rocker arm surfaces differ in shape for individual lift-type intake valves of a cylinder.

3. The adjustable valve gear according to claim 1, wherein surfaces of the rocker arms in the actuating region of the cams have an identical configuration and constitute at least one of the first curve joints, supports of the adjusting shaft forming the second curve joints, and the base-circle tracks and cam tracks of the rocker cams, forming the third curve joints, and the rocker arm surfaces are arranged to be displaced relative to one another in a certain position of the adjusting shaft.

4. The adjustable valve gear according to claim 1, wherein the three curve joints are configured such that the lift curve of one lift-type intake valve is at least substantially unchanged over a speed and load range of the internal combustion engine, while the lift duration and height of the other lift-type intake valve decrease as far as zero as the speed and load decrease.

5. The adjustable valve gear according to claim 1, wherein a rocker lever operatively arranged to actuate a lift-type exhaust valve, is mounted on a cylindrical section of the adjusting shaft, and the at least one camshaft is a single camshaft driving the lift-type exhaust valve and the lift-type intake valves.

* * * * *